US010787024B2

(12) United States Patent
Ventura

(10) Patent No.: US 10,787,024 B2
(45) Date of Patent: Sep. 29, 2020

(54) WRITING UTENSIL STAND

(71) Applicant: Isaac Reyes Ventura, Santa Monica, CA (US)

(72) Inventor: Isaac Reyes Ventura, Santa Monica, CA (US)

( * ) Notice: Subject to any disclaimer, the term of this patent is extended or adjusted under 35 U.S.C. 154(b) by 0 days.

(21) Appl. No.: 16/534,011

(22) Filed: Aug. 7, 2019

(65) Prior Publication Data

US 2020/0062021 A1 Feb. 27, 2020

Related U.S. Application Data

(60) Provisional application No. 62/721,068, filed on Aug. 22, 2018.

(51) Int. Cl.
*B43K 23/00* (2006.01)
*B43M 99/00* (2010.01)

(52) U.S. Cl.
CPC ..... *B43K 23/002* (2013.01); *B43M 99/008* (2013.01)

(58) Field of Classification Search
CPC .... B43K 23/002; B43K 23/00; B43K 23/001; B43M 99/008; B43M 99/006; B43M 99/007; A47F 7/0021; A47F 7/0028
USPC ..... 211/69.5, 60.1, 69.1, 69, 85.18; D19/65, D19/77, 79, 80–85
See application file for complete search history.

(56) References Cited

U.S. PATENT DOCUMENTS

D86,838 S * 4/1932 Hoffman ..... D10/2
1,904,067 A 4/1933 Mcgehee
2,117,459 A * 5/1938 Stanton ..... A47K 1/09 211/65
D110,692 S * 8/1938 Durell ..... D6/682.2
D145,867 S * 11/1946 Fletcher ..... D11/147
D157,024 S * 1/1950 Bacco et al. ..... D6/682.2
D168,307 S * 12/1952 Lenard ..... D6/682.4
D169,077 S * 3/1953 Mains, Jr. ..... D6/682.2
D174,052 S * 2/1955 Muncheryan ..... D10/53
2,752,888 A * 7/1956 Dalton ..... B43K 23/002 312/31
3,109,084 A * 10/1963 Walsh ..... B01L 7/00 219/385
D217,993 S * 7/1970 Woofter ..... D19/23
3,593,856 A 7/1971 Zander
4,066,171 A * 1/1978 Fowlie ..... B43M 99/001 211/13.1
D251,644 S * 4/1979 Ravn ..... D6/571
D255,369 S * 6/1980 de Gross ..... D10/15
(Continued)

*Primary Examiner* — Jennifer E. Novosad

(74) *Attorney, Agent, or Firm* — Boudwin Intellectual Property; Daniel Boudwin

(57) ABSTRACT

A writing utensil stand including a base having a planar lower side configured to be supported on a horizontal surface such as a table or countertop. The writing utensil stand includes a plurality of cylindrical bores which are disposed on an upper side of the device, wherein each bore includes an opening that is sized to receive a writing instrument, such as a pen or pencil, therethrough. At least one viewing aperture is disposed on the base and extends from a front side of the base through a rear side thereof. At least one of the bores extends through the viewing aperture and terminates at the lower side of the base, such that the viewing aperture allows individuals to observe a lower portion of the writing instrument for proper identification when stored.

2 Claims, 3 Drawing Sheets

(56) References Cited

U.S. PATENT DOCUMENTS

D271,638 S * 12/1983 Basaldua, Jr. ..... D19/77
4,450,967 A * 5/1984 Castro ..... F41B 5/14 124/23.1
D275,206 S * 8/1984 Fineout ..... D19/77
D283,049 S * 3/1986 Pandya ..... D19/75
D283,164 S * 3/1986 Pandya ..... D19/75
4,779,742 A 10/1988 Starkweather et al.
D298,953 S * 12/1988 Roberts ..... D10/2
D301,422 S * 6/1989 Schmidt ..... D19/105
5,025,934 A * 6/1991 Vogel ..... A47F 7/0028 211/60.1
D321,371 S * 11/1991 Galante ..... D19/75
5,129,528 A * 7/1992 Eidsmoe ..... B25H 3/003 211/69
5,141,117 A 8/1992 Olsen et al.
D329,304 S * 9/1992 Tipp ..... D28/38
D333,770 S * 3/1993 Jureckson ..... D8/71
D336,802 S * 6/1993 Eidsmoe ..... D19/75
5,484,066 A 1/1996 Luisi
D375,890 S * 11/1996 Takai ..... D8/380
5,615,782 A * 4/1997 Choe ..... A45D 1/00 211/60.1
D383,568 S * 9/1997 Giedd ..... D19/103
5,687,855 A * 11/1997 Heller ..... A47K 1/09 211/65
D462,199 S * 9/2002 Heagen ..... D19/82
D483,068 S * 12/2003 Magee ..... D10/2
6,929,116 B2 8/2005 Chao et al.
7,036,668 B2 * 5/2006 Udy ..... B25H 3/04 211/60.1
D534,961 S * 1/2007 Crawford ..... D19/85
D555,936 S * 11/2007 King ..... D6/675.3
D618,280 S * 6/2010 Siegel ..... D19/85
D657,223 S * 4/2012 Huang ..... D8/71
D669,528 S * 10/2012 Strain ..... D19/105
8,464,868 B2 * 6/2013 Kruger ..... A47B 88/90 206/362.1
8,893,886 B2 * 11/2014 Tsukaguchi ..... B25B 15/008 206/377
D720,400 S * 12/2014 Featherston ..... A44C 5/0046 D19/85
D721,930 S * 2/2015 Dohy ..... D7/708
D730,986 S * 6/2015 Moreau ..... D11/201
9,517,440 B2 * 12/2016 Luethi ..... B01F 11/0028
D776,195 S * 1/2017 Janosik ..... D19/85
D787,701 S * 5/2017 Wilson ..... D24/227
2007/0163973 A1 * 7/2007 Smokowicz ..... A01G 5/04 211/70

* cited by examiner

WRITING UTENSIL STAND

CROSS REFERENCE TO RELATED APPLICATIONS

This application claims the benefit of U.S. Provisional Application No. 62/721,068 filed on Aug. 22, 2018. The above identified patent application is herein incorporated by reference in its entirety to provide continuity of disclosure.

BACKGROUND OF THE INVENTION

The present invention relates to writing instrument holders. More specifically, the present invention provides a writing utensil stand having a plurality of bore holes adapted to receive said utensils wherein at least one viewing window extending from a front side through a rear side of the base allows a writing utensil inserted through one of the plurality of bore holes to be visible. There is also at least one bore hole disposed adjacent to the viewing window such that a writing utensil inserted therein is obscured from view. Alternate embodiments allow for multiple viewing windows and bore hole positions.

People are often searching for a pencil or pen to jot down ideas and items, take notes, and write various other things. Unfortunately, many people frequently store utensils in a draw or other object only to later forget where they placed there writing utensil. The problem of locating the writing utensils is exacerbated when people place their writing utensils without much deliberation or organization. Further, even when writing utensils are clustered in one location, an individual may have trouble distinguishing between a pen or pencil. Accordingly, a device that is configured to store writing utensils such that a user of said device may easily locate and identify a desired writing utensil is desired. Therefore, there is a need in the prior art for a convenient means for storing and easily identifying writing utensils and the like.

Devices have been disclosed in the known art that relate to writing utensil stands. These include devices that have been patented and published in patent application publications. These devices generally relate to writing utensil stands that allow the contents thereof to be viewed from the exterior. One known art device provides a stand made of a ceramic material for holding writing instruments in rows of holes in a rectangular shape. Other devices in the known art generally relate to writing utensil holders that are adhesive to a backpack or automobile dashboard. These devices, however, fail to disclose a writing utensil stand including at least one viewing aperture extending from a front side through a rear side of the base that allows a writing utensil to be inserted through one of a plurality of bore holes to be visible, as well as at least one bore hole disposed adjacent the aperture, such that a writing utensil inserted therein is obscured from view.

SUMMARY OF THE INVENTION

In view of the foregoing disadvantages inherent in the known types of writing utensil stands now present in the known art, the present invention provides a writing utensil stand with both concealed and visible compartments wherein the same can be utilized for providing convenience for the user when storing and choosing writing utensils.

It is therefore an object of the present invention to provide a new and improved writing utensil stand that has all of the advantages of the known art and none of the disadvantages.

It is another object of the present invention to provide a base having a planar bottom configured to be supported on a flat surface, and a top surface including a plurality of bore holes that are adapted to receive a writing utensil therethrough. The base also includes a front surface and a back surface wherein at least one viewing aperture extends from the front surface through the back surface.

Another object of the present invention is to provide a writing utensil stand wherein the bore holes disposed through the top surface of the base include an indentation around the opening and are of varying diameters to better receive writing utensils of varying dimensions therein.

Yet another object of the present invention is to provide a writing utensil stand wherein the base is made of a rigid material such as wood or plastic and clear windows enclose the view apertures between the front and back surfaces.

Another object of the present invention is to provide a writing utensil star wherein geometric inserts conforming to the dimensions of the view hole having corresponding bore holes are removably insertable within the base such that writing utensils may be inserted concurrently through the base and the insert.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
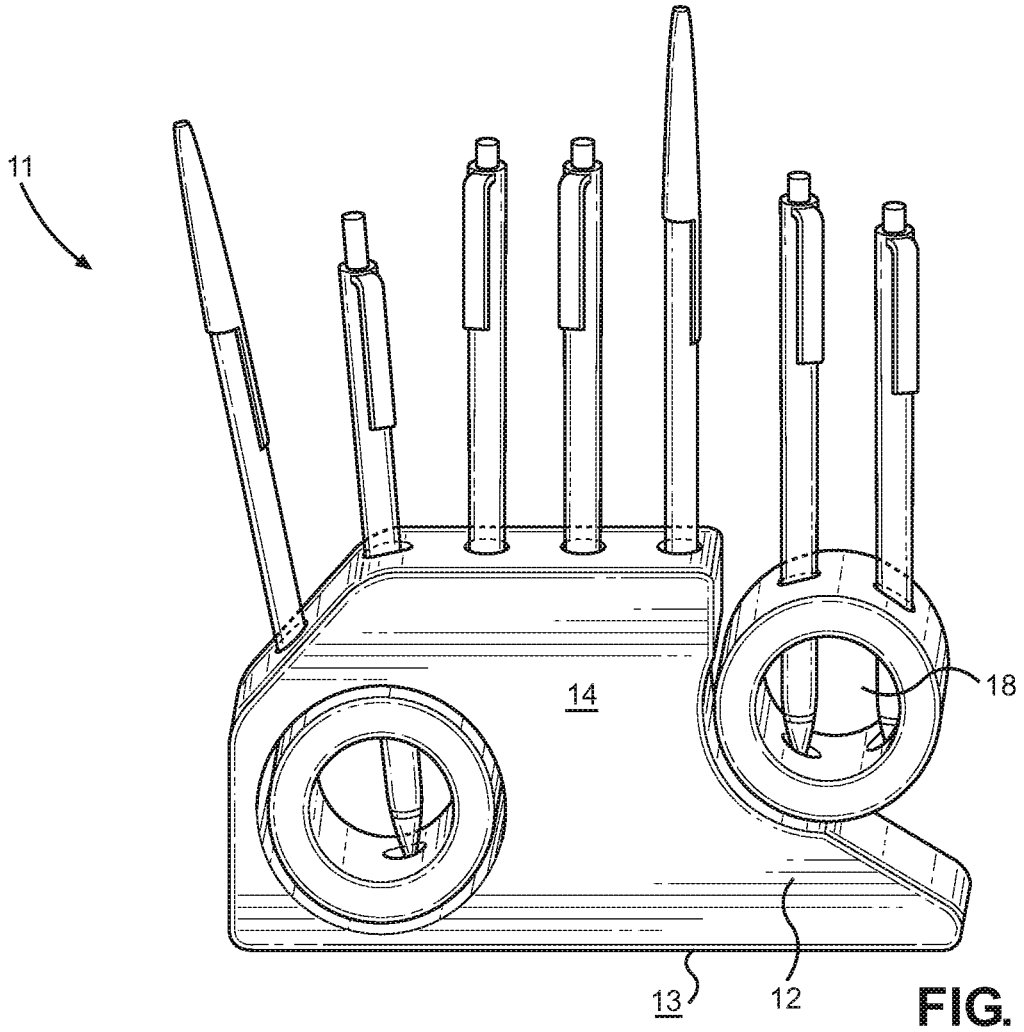
FIG. 1 shows a perspective view of an embodiment of the writing utensil stand.

Reference is made herein to the attached drawings. Like reference numerals are used throughout the drawings to depict like or similar elements of the writing utensil stand. For the purposes of presenting a brief and clear description of the present invention, the preferred embodiment will be discussed as used for storing and displaying writing utensils in a plurality of bore holes and viewing apertures. The figures are intended for representative purposes only and should not be considered to be limiting in any respect.

Figure 2:
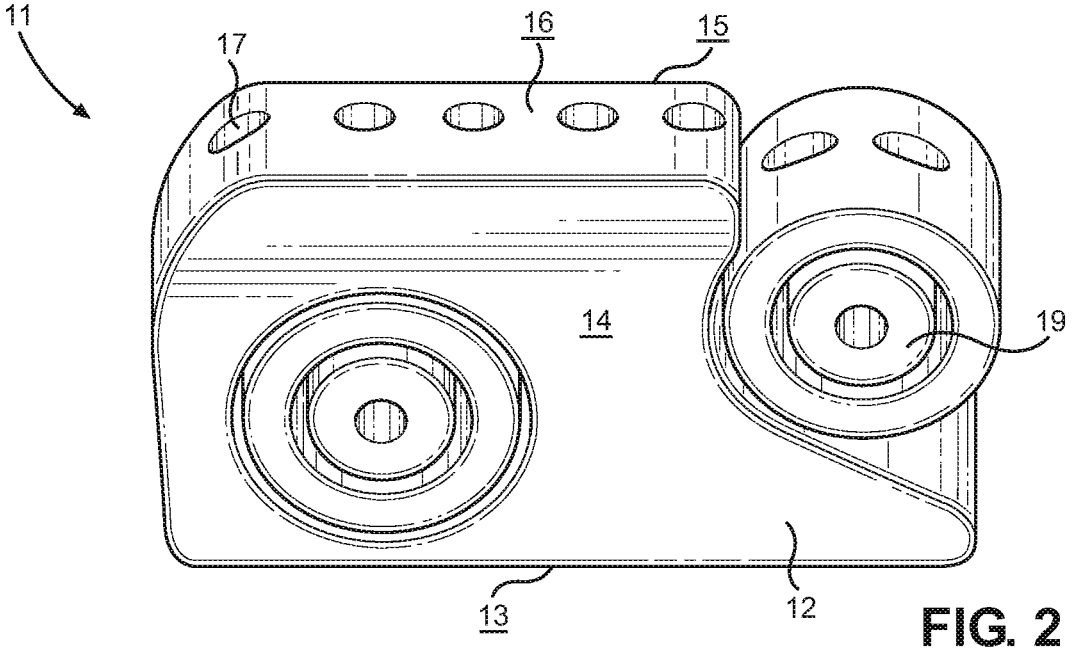
FIG. 2 shows a perspective view of an embodiment of the writing utensil stand with writing utensils removably installed.

Referring now to FIG. 1 and FIG. 2, there is shown perspective views of embodiments of the writing utensil stand. The writing utensil stand 11 comprises a base 12 having a planar lower surface 13 configured to be supported on a flat, horizontal surface. In the illustrated embodiment, the planar lower surface 13 of the base 12 comprises a rectangular shape, however, alternate embodiments may comprise a planar lower surface 13 of any suitable shape, such as a trapezoid or oval. The device further includes a front surface 14, a back surface 15, and an upper surface 16. A plurality of bore holes 17 are disposed in the upper surface 16 of the device 11 and descend vertically through the base 12 and terminate in a lower portion thereof. The plurality of bore holes 17 are adapted to receive a writing utensil therethrough and, in the illustrated embodiment, are comprised of a cylindrical dimension. In alternate embodiments, the plurality of bore holes 17 may comprise different dimensions and diameters as to receive writing utensils are varying sizes and shapes.

Figure 3:
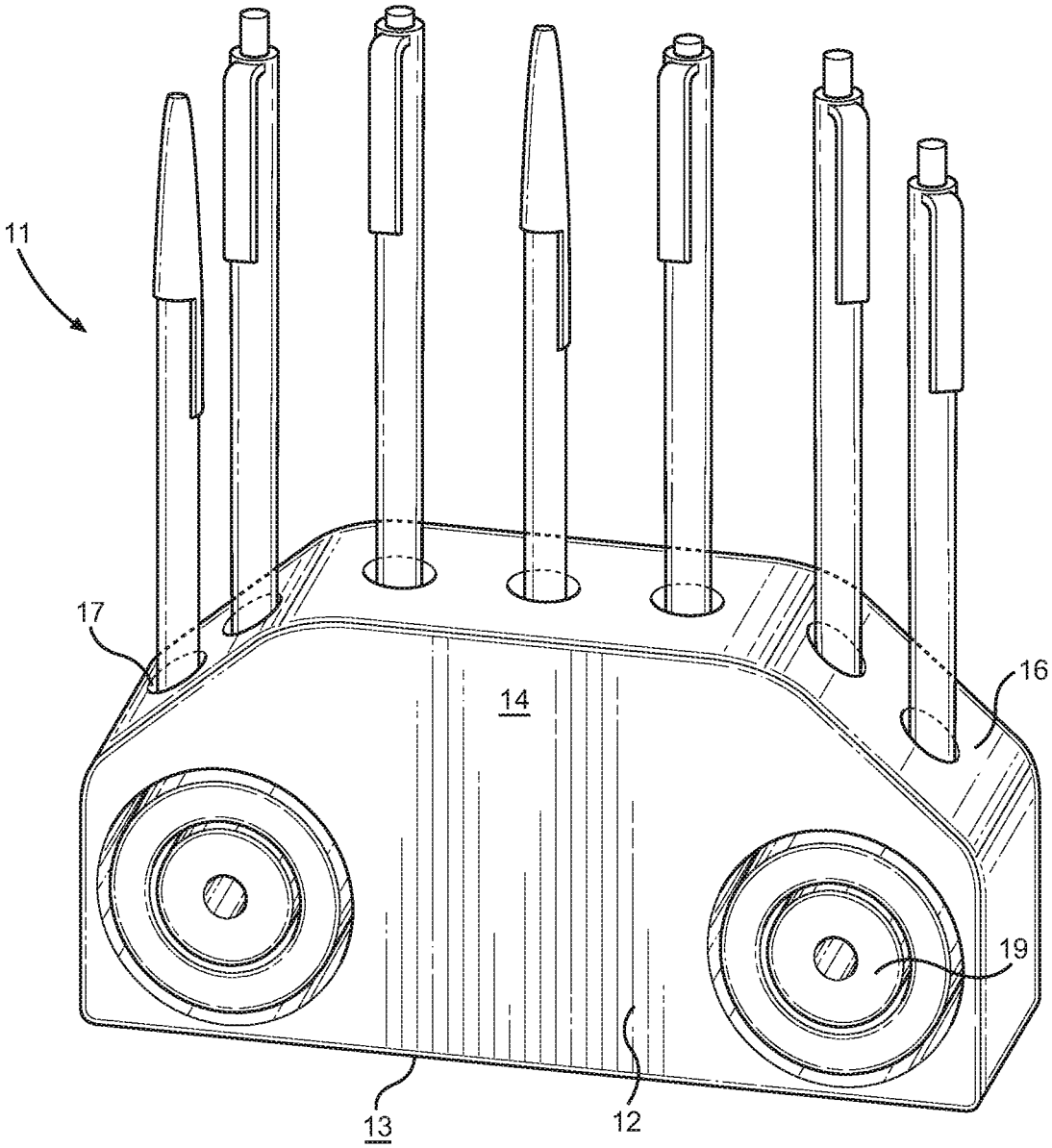
FIG. 3 shows a perspective view of an embodiment of the writing utensil stand with geometric insert and writing utensils removably installed.

Referring now to FIGS. 1, 2 and 3, there is shown a perspective view of an embodiment of the writing utensil stand with writing utensils removably installed, and a perspective view of an embodiment of the writing utensil stand with geometric insert 19 and writing utensils removably installed, respectively. At least one viewing aperture 18 is disposed in the base 12 and extends from the front 14 surface through the back surface 15, creating a void through the base 12. At least one of the plurality of bore holes 17 extends through a viewing aperture 18 and terminates in the lower portion of the base 12, near the planar lower surface 13 while at least one other bore hole 17 extends through the base 12 without passing through a viewing aperture 18. In practice, writing utensils may either be installed in bore holes 17 that pass through a viewing aperture 18 or one that does not. Writing utensils that pass through a viewing aperture 18 may be seen by a user without having to remove the writing utensil from the bore hole 17 itself. A writing utensil installed in a bore hole 17 that extends through a viewing aperture 18 also allows a user to properly identify what type of utensil is contained therein and also whether the utensil has sufficient ink or fluid.

Figure 4:
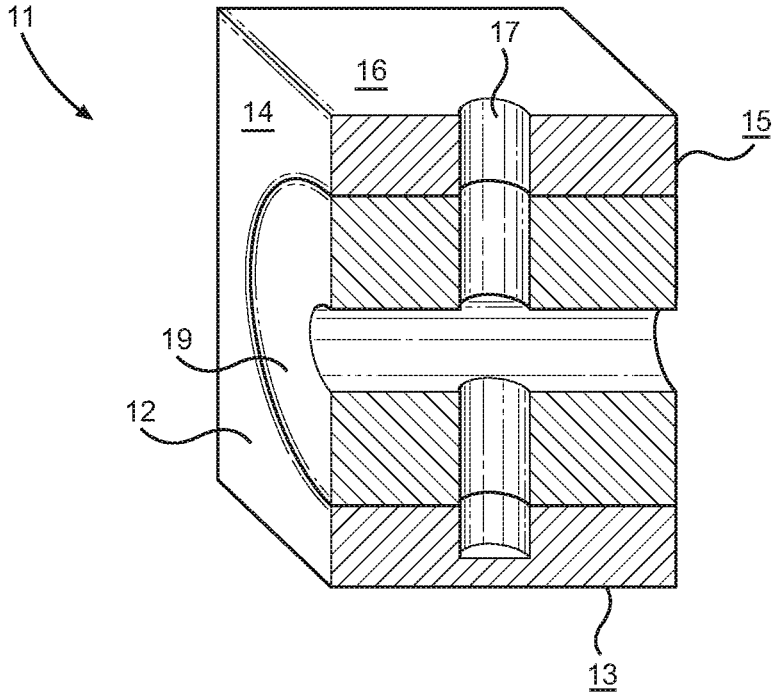
FIG. 4 shows a cross-sectional view of an embodiment of the writing utensil stand with geometric insert installed.
Figure 5:
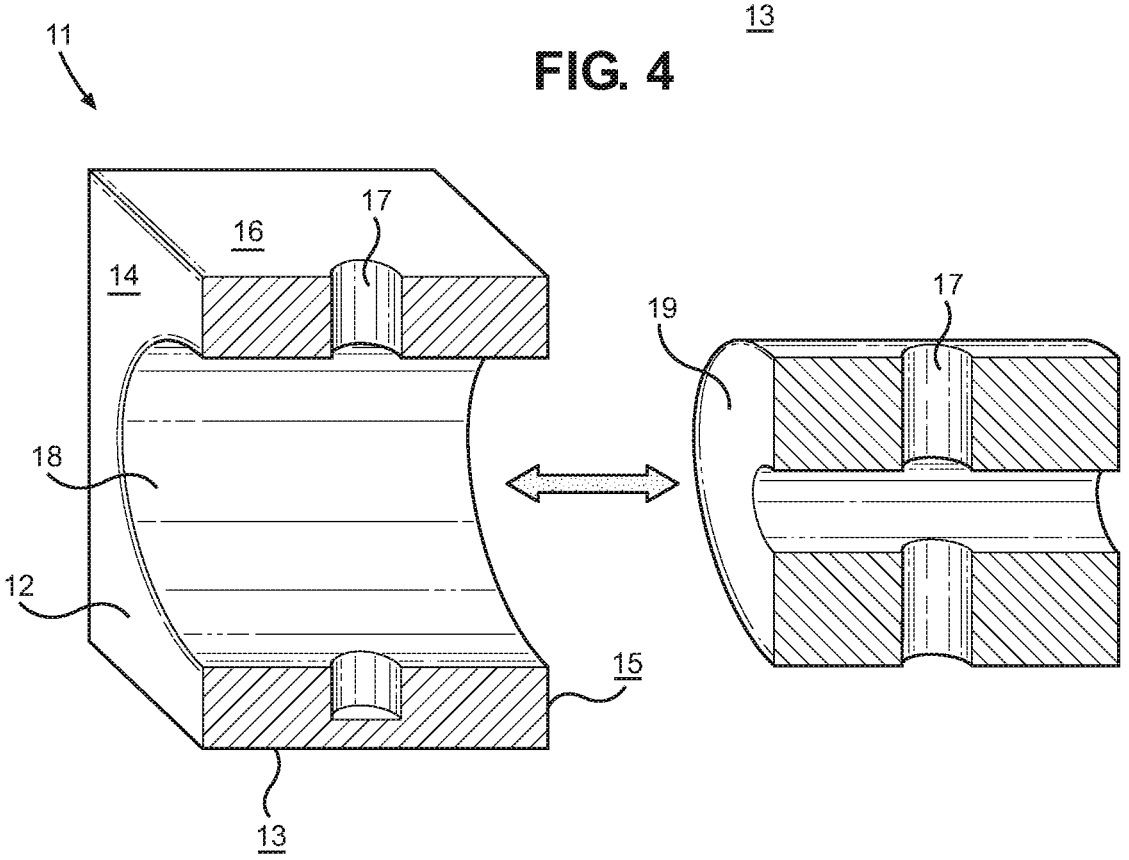
FIG. 5 shows a deconstructed cross-sectional view of an embodiment of the writing utensil stand with geometric insert removed.

Referring now to FIGS. 4 and 5, there is shown a cross sectional view of an embodiment of the writing utensil stand with geometric insert installed and a deconstructed cross-sectional view of an embodiment of the writing utensil stand with geometric insert removed, respectively. The writing utensil stand 11 may include geometric inserts 19 that correspond with the shape of the viewing aperture 18 disposed through the base 12. Bore holes 17 disposed on the geometric inserts 19 also correspond with the bore hole 17 disposed through the upper surface 16 of the base 12 allowing writing utensils installed in the bore holes 17 to pass through the geometric insert 19 and terminate in the lower portion of the base 12, near the planar lower surface 13. The device 11 may be used with or without the geometric inserts 19 installed as a user so desires. To install the geometric inserts 19 within the base 12, a user may slide the geometric insert 19 into the corresponding viewing aperture 18 which is dimensioned to receive the geometric insert 19 through the front surface 14 or back surface 15 of the base 12. The geometric insert 19 is configured to selectively obscure a portion of the writing utensil which passes therein while providing an improved aesthetic feature to the base 12 of the device 11.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A writing utensil stand, comprising:

a base having a planar bottom surface adapted to be laid flush on a flat and level surface, a top surface, a front surface, and a back surface;

at least one viewing aperture extending from said front surface of said base through said back surface;

a plurality of cylindrical bore holes disposed through said top surface of said base configured to receive a writing utensil therethrough, wherein at least one of said bore holes extends through at least one of said viewing apertures and terminates at a lower side of said base, and wherein at least one of said bore holes is enclosed along a length thereof within said base;

at least one geometric insert configured to conform to the dimensions of the at least one viewing aperture, wherein each geometric insert includes corresponding bore holes and is removably insertable within the base such that writing utensils may be inserted concurrently through the base and the insert.

2. The writing utensil stand of claim 1, wherein the base is composed of a rigid construction material selected from the group consisting of wood, metal, or plastic.

* * * * *